United States Patent [19]

Mele et al.

[11] Patent Number: 4,904,981

[45] Date of Patent: Feb. 27, 1990

[54] MULTIFUNCTIONAL BASKETBALL GAME MONITORING UNIT

[76] Inventors: Thomas C. Mele; Mary K. Mele, both of 4804 Palisade Dr.; Robert C. Dyer; Margaret A. Dyer, both of 4806 Palisade Dr., all of Austin, Tex. 78731

[21] Appl. No.: 293,703

[22] Filed: Jan. 5, 1989

[51] Int. Cl.[4] ..... G08B 23/00; A63B 71/06

[52] U.S. Cl. ..... 340/323 R; 340/323 B; 340/665; 273/1.5 A; 273/1.5 R; 364/411

[58] Field of Search ..... 340/323 R, 323 B, 665, 340/309-315; 364/411, 410; 377/5; 273/1.5 R, 1.5 A

[56] References Cited

U.S. PATENT DOCUMENTS 3,868,671 2/1975 Maguire ..... 273/1.5 R
4,062,008 12/1977 Carlsson ..... 340/323 R

FOREIGN PATENT DOCUMENTS 1021369 12/1977 Canada ..... 273/1-5 R

*Primary Examiner*—Donnie L. Crosland
*Assistant Examiner*—Kinfe-Michael Negash
*Attorney, Agent, or Firm*—J. F. Long

[57] ABSTRACT

A multifunctional basketball monitoring unit that allows visual display and print out of a total baskets made score and the percentage of total baskets made of total baskets attempted in free throw and goal shooting either under time pressure or with no time limitation.

6 Claims, 3 Drawing Sheets

MULTIFUNCTIONAL BASKETBALL GAME MONITORING UNIT

BACKGROUND OF THE INVENTION

This invention pertains to a unit to store, calculate and display data relative to the number of times a basketball passes through a hoop and the number of times a basketball strikes a backboard or rim indicating that the player has attempted to make a basket.

In a first embodiment electronic circuitry in the unit receives data from:

1. a sensing means across the basketball hoop to sense when the basketball has passed through the hoop; this sensing means could be infra-red, a photo-cell, a capacitor or other means that would not affect the play of the game;

2. an impact sensor on a basketball backboard to sense when the basketball strikes the rim of the hoop or the backboard.

The electronic circuitry in the unit is preprogrammed to calculate and store the total score and shooting percentage or number of times the basketball passes through the hoop divided by the total number of times the basketball impacted the backboard, plus passed through the hoop. The output number is multiplied by 100 to display and store shooting percentage. In first embodiment output may be to an internal speaker, and to a scoreboard display mounted in the unit. In this embodiment, electronic circuitry within the unit and the scoreboard display mounted in the unit is set up so that each player may have a first time period to throw the basketball through the hoop with the unit calculating, storing, and displaying shots made, shooting percentage, and time remaining in a period. The second player then has the same period of time to play in the first time period. Each player may play four periods or quarters with scoring of each player for each quarter and for each player for four quarters allowing competition per quarter or per game.

Output of different audible tones generated and outputted through the internal speaker may be used to indicate:

1. start of period;
2. a basket made;
3. ten second count down before period ends;
4. high score or high shooting percentage;
5. end of game period.

The unit may be used for a player to monitor his performance shooting baskets by watching the scoreboard. He may pick a fixed time period and monitor his total score and shooting percentage against time or may monitor his total score and shooting percentage while playing with little time pressure such as "free" throws allowed in a normal game.

In a second embodiment the circuitry may be modified to:

1. receive input from a numeric keypad for command to the central processing unit (CPU) of the electronic circuitry;

2. have a printer connection port;

3. include a video processor which then connects with a T.V. set with both video and audible output from the T.V. set;

4. eliminate the unit mounted scoreboard display.

In this embodiment the visual display is only on the T.V. screen and the unit will display baskets made, percentage of baskets made, total score, time remaining in a chosen period, and will emit different tones thru the T.V. speaker for baskets made, highest score percentage made, and a chosen time remaining in the period and start and end of game period. Date, time, and player identification may be stored along with play scores for later or simultaneous print out when a printer is plugged into the unit and activated.

This second embodiment is particularly suitable for a coach to measure performance as individual players practice shooting goals under anyone of a number of chosen conditions. The impact sensor to sense when a goal is attempted and not made allows monitoring of performance in a unique manner. Storing, dating, and printing out percentage baskets made, and total score in a given period allows a player or coach to monitor improvement over time.

Although an impact sensor has been used to sense when a basket is attempted and not made, other sensors may be also used either alone or in conjunction with an impact sensor. Other sensors that may be used include a modified radar, infra-red, photo electric beams properly spaced, spaced laser beams, a capacitor type, etc.

BRIEF DESCRIPTION OF THE INVENTION

A first embodiment of the invention may be described as follows:

1. A housing with a rechargeable battery plus charging circuitry and, for alternate use, a rectifying circuit that may be plugged into 110 V A.C. to power the electronic circuitry of the unit through an on-off switch.

2. Input to the electronic circuitry from:

a. an infra-red sensor to sense when a basketball passes through the hoop;

b. an impact sensor to detect when a ball impacts the backboard or hoop without going through the basket, the electronic circuitry corrects impact on the hoop when the ball immediately falls through the basket, the goals attempted equal the total times either of the two sensors are activated minus the correction;

c. scoreboard display assembly, with a power "ON" switch to interface the assembly with the electronic circuitry and a start button to start a game, a player select switch to select single or double player option and a time select switch to allow selecting a timed period option.

3. The electronic circuitry acts:

a. to receive input data as outlined;

b. to store input data;

c. to calculate total score, and percentage of goals made or shooting percentage using goals made and goals attempted, correcting for impact when ball almost simultaneously goes through the hoop;

d. to generate and feed to an internal speaker different tones to indicate;
   1. basket made,
   2. game period start,
   3. ten second countdown left in game period,
   4. high score or high shooting percentage,
   5. game period end;

e. output to scoreboard display assembly-date, time, or game time remaining, accumulative score and shooting percentage for player 1 or score for player 1 and player 2 when double player option is selected, a light to indicate time period in play—up to 4 periods;

f. timer means with switch to automatically turn off power to the unit when the unit has not been used for a chosen period of time such as ten minutes.

The electronic circuitry is further described in the drawings and description of the drawings.

In a second embodiment the electronic circuitry includes a rectifier circuit to allow 110 V A.C. input, an external numeric keypad input and also a keypad mounted in the unit, an output port for a printer, a video processor and an output port for a T.V., with the video processor contained within the housing and clock mechanism to output time and date. This simplified circuitry indicates cumulative score, scoring percentage, and time remaining in a period chosen on an external T.V. and also saves the data for print out on command from the numeric keypad. A player identification number and time and date will be saved for print out when entered through the numeric keypad.

The invention covers a first embodiment uniquely suited for local monitoring on a housing mounted display for a one or two man game comprising competition between two men or against one man's previous score in picked time periods where the game consists of shooting baskets.

With some circuitry modifications a second embodiment is uniquely suited for monitoring a players performance in throwing baskets on a basketball court with visual and audible read out while storing data for print out to monitor improvement with time.

In both embodiments, sensors such as impact sensors and infra-red sensors to determine baskets made allow unique instantaneous determination of free throw shooting percentage under no time pressure or under chosen time pressure.

Several modifications to sensors (including magnetic, radar, banked photo electric cells, laser beams and other proximity sensors) and outputs could be made by one of normal skill in the art so we do not wish to be limited to exact details but only to the general spirit and purpose as outlined in the claims and specifications.

DETAILED DESCRIPTION OF THE DRAWINGS

Figure 1:
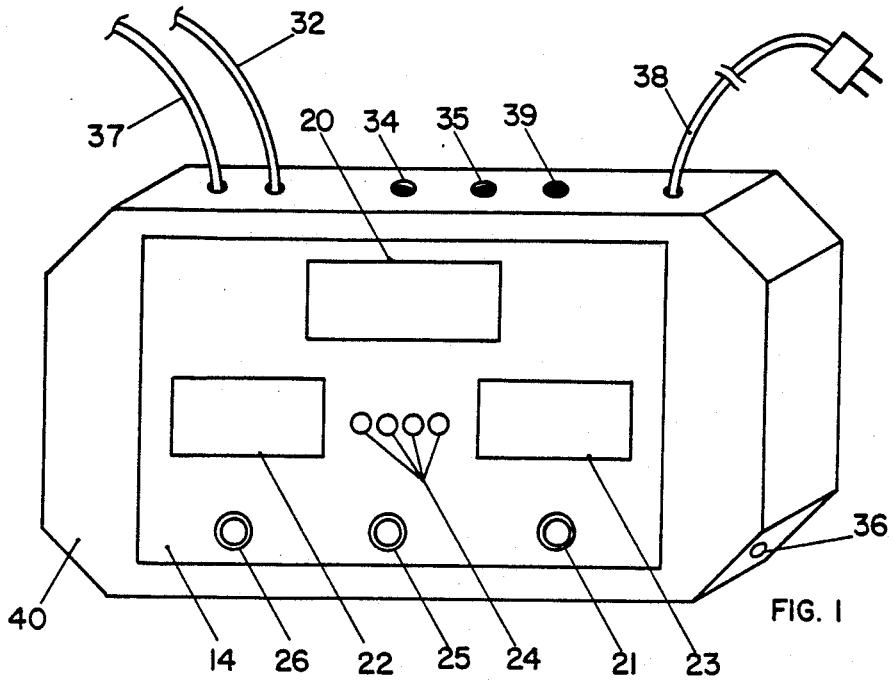
FIg. 1 shows a view of the housing for the first embodiment of the Multifunctional Basketball Game Monitoring Unit.
Figure 3:
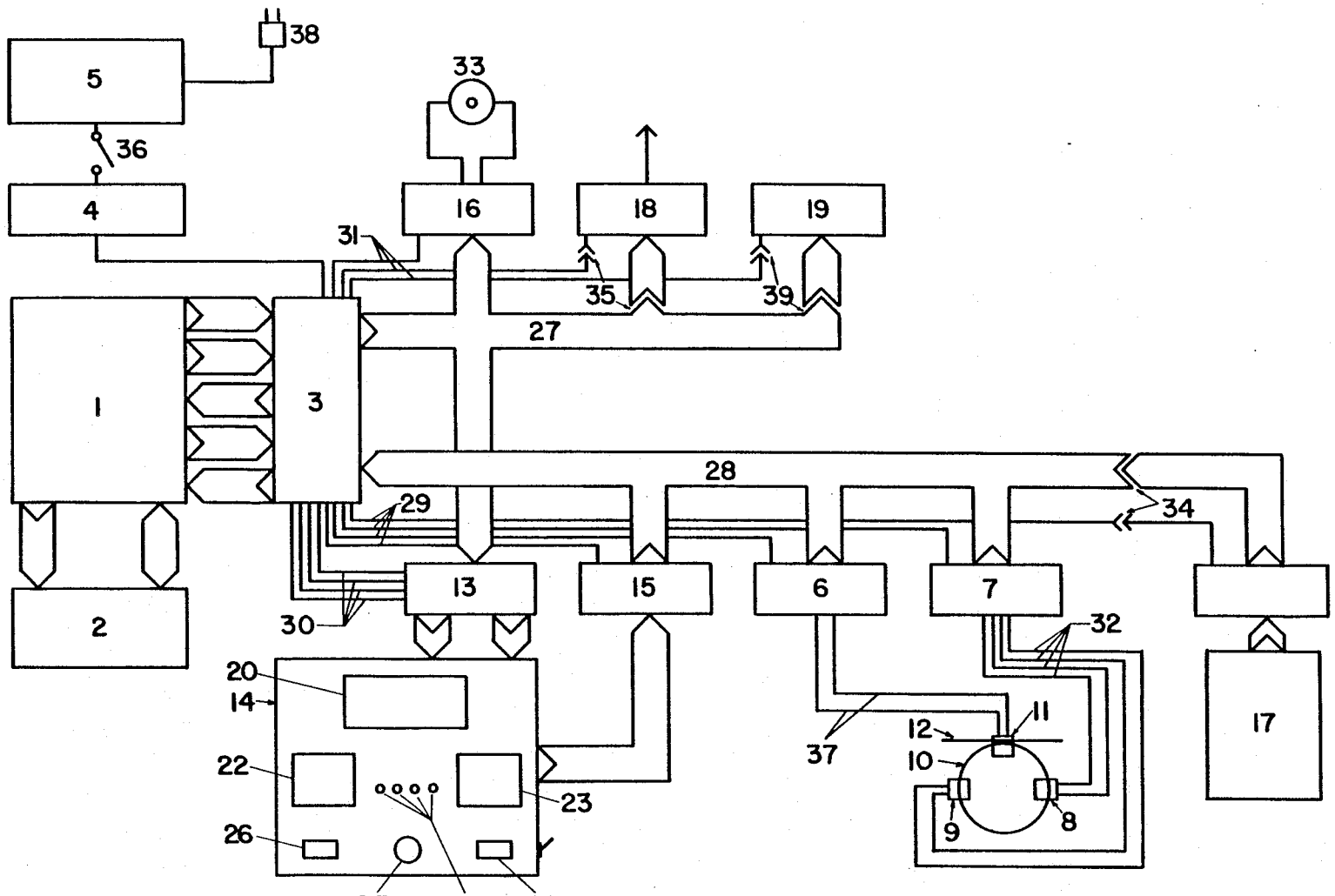
FIG. 3 shows a diagram for electronic circuitry in the first embodiment of the Multifunctional Basketball Game Monitoring Unit.

In FIG. 1 we show a housing 40 containing electronic circuitry, further detailed in FIG. 3, for a first embodiment of the invention. The housing mounted scoreboard display assembly 14 includes:

1. a power on-off switch 36, the settings of switch 21 that allows single or double player option to be selected; start button or switch 25 to start the game sequence and a time mode select switch 26 that allows choice of a timed period option;
2. display 22 which will display accumulative score and display 23 which will show shooting percentage when switch 21 is set to single player and switch 26 is in time mode "ON".

When switch 21 is set to two players and time mode switch 26 is "ON" display 22 will display player 1's accumulative score and display 23 will display player 2's accumulative score: when switch 21 is set to two players and switch 26 is in time mode "OFF" no distinction between players is made and display 22 displays accumulative score and display 23 displays shooting percentage.

When time period switch 26 is in "ON" position a player receives 3 points for each basket made in last 10 seconds of his time period and two points for each basket made previously; when time period switch 26 is in "OFF" position each basket made counts 2 points;

3. display 20 will display time remaining in a period when time select switch 26 is in the "ON" position and displays date and time when time select switch 26 is in the "OFF" position;
4. four period lights 24 indicate periods or quarters when time select switch 26 is in the time mode "ON":

Inlet and exit connections to the electronic circuitry within the housing 40 are as follows;

a. incoming line 32 from Infra-red emitting diode and detector mounted on the rim or hoop,
b. incoming line 37 from the impact detector,
c. incoming 110 V A.C. 38 that leads either to a battery charger 5, FIG. 3 in the electronic circuitry or to a rectifier in the power unit,
d. exit plug 34 for a numeric keypad 17, FIG. 3
e. exit plug 35 for connection to a video processor 18, FIG. 3 and,
f. exit plug 39 for connection to a printer 19.

Figure 2:
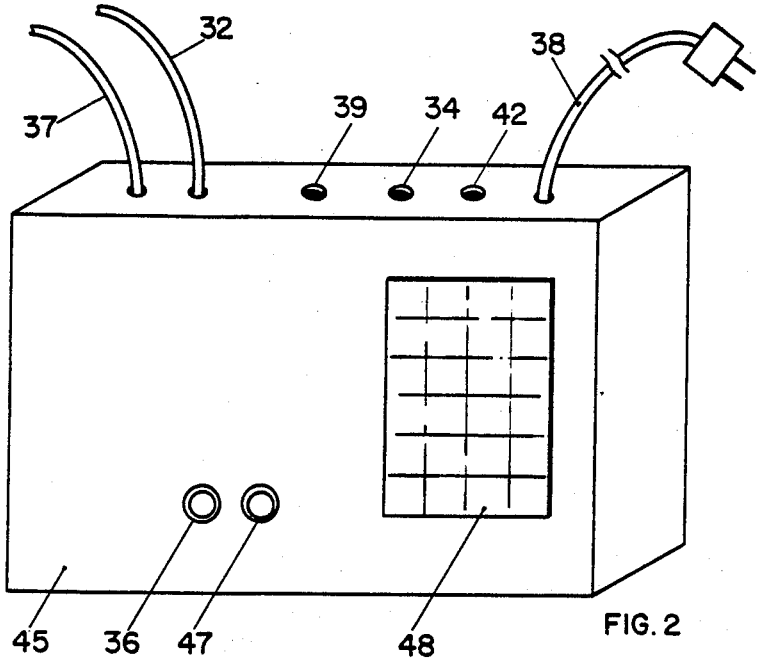
FIG. 2 shows a view of the housing and peripheral equipment of a second embodiment of the invention.
Figure 4:
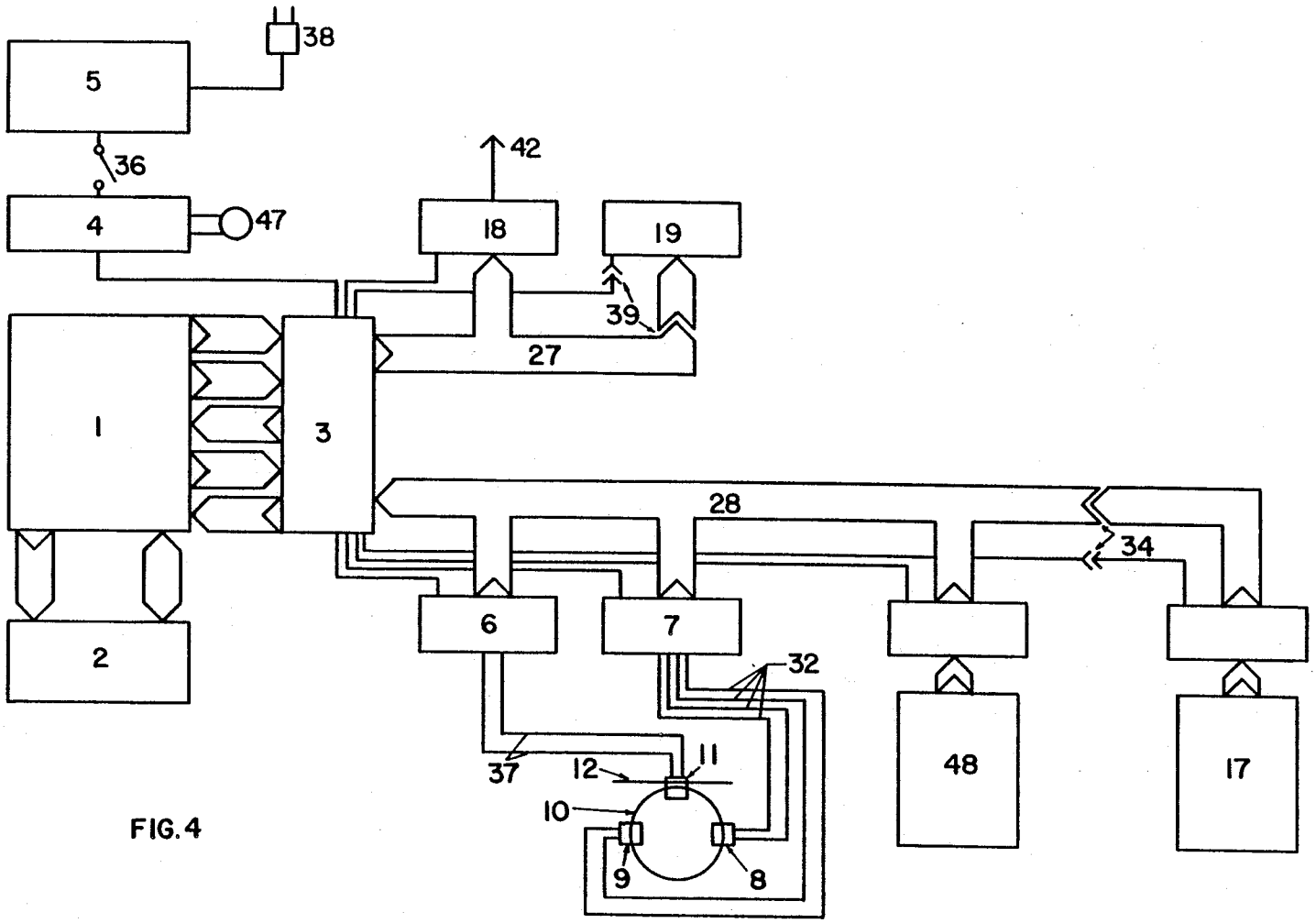
FIG. 4 shows a diagram for electronic circuitry in a second embodiment of the invention.

FIG. 2 shows housing 45 for a second embodiment of the invention, an on-off switch 36, a power "ON" indicator light 47 and a numeric keypad 48 for input to electronic circuitry further detailed in FIG. 4.

Inlet and exit connections to electronic circuitry within housing 45 are as follows:

1. inlet from IR sensor 32;
2. inlet from Impact sensor 37;
3. exit connection 39 for a printer;
4. exit connection 34 for an external numeric keypad input;
5. exit connection 42 to a T.V. display;
6. Power inlet line 38.

FIG. 3 schematically indicates electronic circuitry for the FIG. 1 embodiment and shows central processor unit 1 with components to produce circuitry performance as outlined under the detailed description of the drawings with a proper nonerasable program in memory unit 2 that communicates with the central processor unit 1. The central processor unit 1 also communicates with an input/output controller 3 through an address bus, a control output bus, control input bus, a data output bus and a data input bus. The input/output controller 3 is connected to power control circuitry 4 which receives current from power supply 5 which comprises batteries connected with recharger circuitry and inlet 110 V A.C. 38.

The input/output or I/O controller 3 receives input from the input data bus 28 and lines 29 select which input from the impact sensor detection circuitry 6, the infra-red control and detection circuitry 7 scoreboard switch control circuitry 15, or numeric keypad 17 has control of the data bus. The infra-red or IR control/detection circuitry 7 energizes an IR source 9 at a fixed frequency, communicates with IR detector 8 and counts a basket via impulse to the I/O controller 3 and central processing unit or CPU 1 when an object passes through hoop 10 mounted on backboard 12. Impact detection circuitry 6 is connected with impact detector 11 connected to backboard 12 and rim 10 and determines impact when an object such as a basketball strikes the rim 10 or backboard 12. A signal is sent to I/O controller 3 and CPU 1 and, if, almost simultaneously the IR detection system indicates a basket has been made, the impact is not counted as a miss, otherwise the impact is counted as a miss and used in percentage calculations.

The control lines 30 allow the central processing unit 1 to select which data will be displayed in scoreboard display 14. The data to be displayed will be sent to the displays on the data output bus 27 through scoreboard display control 13. The control lines 31 allow the central processing unit 1 to select which output device speaker 16, videoprocessor 18 or printer 19 has control of the data output bus 27.

Scoreboard switch control 15 interfaces the scoreboard 14 with the data input bus 28. The functions of start switch 25, ON/OFF time mode switch 26, player 1-player 2 setting 21, player 1 display 22, four period lights 24, player 2 display 23, and timer display 20 have been previously described under FIG. 1.

Further, the circuitry shows plug 34 for plug in of numeric keypad 17, plug 39 for plug in of printer 19, plug 35 for plug in of a video processor 18. The input-/output controller 3 sends output on the output data bus 27 and lines 31 select which device, sound effect driver circuitry 16, printer 19, or video processor 18 has control of the data bus.

In FIG. 4 we show electronic circuitry for the second embodiment of the invention. Briefly this electronic circuitry is the electronic circuitry as outlined in FIG. 3 modified to delete the housing mounted scoreboard display 14, scoreboard control switch 15, and scoreboard display control 13 and to add an internal video processor unit 18, an internal numeric keypad 48, a plug in connection for a printer 39. A plug in connection 42 to a T.V. from the video processor 18 is used to output both calculated scores and percentages and sounds as well as other data that could be input from the numeric keypad.

LEGEND FIG. 1

14 Scoreboard display assembly
20 Timer display
21 Player 1 or 2 switch
22 Player 1 display
23 Player 2 display
24 Period lights
25 Start switch
26 Time period on/off switch
32 Signal lines from infra-red detector and emitting diode
34 External numeric keypad input port
35 Video processor port
36 Power on switch
37 Signal lines from impact detector
38 110 V A.C.
39 Printer output port
40 Housing

LEGEND FIG. 2

32 Signal lines to infra-red detector and emitting diode
34 External numeric keypad input port
36 Power on switch
37 Signal lines from impact detector
38 110 V A.C.
39 Printer output port
42 T.V. cable plug
45 Housing
47 Power on/off light
48 Numeric keypad

LEGEND FOR FIRST EMBODIMENT ELECTRONIC CIRCUITRY—FIG. 3

| NUMBER | DESCRIPTION |
|---|---|
| 1 | Central processing unit |
| 2 | Memory unit |
| 3 | Input/output controller |
| 4 | Power control circuitry |
| 5 | Power supply with 110 V A.C. inlet plug 38 |
| 6 | Impact detector circuitry |
| 7 | Infra-red detector circuitry |
| 8 | Infra-red detector |
| 9 | Infra-red emitting diode |
| 10 | Hoop |
| 11 | Impact detector |
| 12 | Backboard |
| 13 | Scoreboard display control circuitry |
| 14 | Internal scoreboard |
| 15 | Scoreboard switch control circuitry |
| 16 | Sound effect driver circuitry with speaker 33 |
| 17 | Numeric keypad input |
| 18 | External video processor |
| 19 | External printer |
| 20 | Timer display |
| 21 | Player 1 or player 2 choice switch |
| 22 | Player 1 score display |
| 23 | Player 2 score display |
| 24 | Four period lights |
| 25 | Start switch |
| 26 | Time period on/off switch |
| 27 | Data output bus |
| 28 | Data input bus |
| 29 | Control lines selecting which input device scoreboard switch control 15, impact detection circuitry 6, infra-red control/detection circuitry 7, or numeric keypad 17 has control of data input bus 28 |
| 30 | Control lines to select which display on scoreboard 14 is active |
| 31 | Control lines selecting which output device, sound effects drive 16, video processor 18, or printer 19, has control of data output bus 27 |
| 32 | Signal lines to infra-red emitter 9 and detector 8 |
| 33 | Speaker |
| 34 | Numeric keypad exit plug |
| 35 | Video processor exit plug |
| 36 | Power ON/OFF switch |
| 37 | Signal lines from impact detector |
| 38 | 110 V A.C. plug |
| 39 | Printer exit plug |

LEGEND FIG. 4—SAME AS FIG. 3 PLUS

| LEGEND FIG. 4 - SAME AS FIG. 3 PLUS | |
|---|---|
| 42 | Plug in for T.V. |
| 47 | Power ON indicator light |
| 48 | Internally connected numeric keypad |

What is claimed is:

1. A multifunctional basketball game monitoring unit comprising:

A. an impact sensing means to detect when a basketball touches a backboard and feed a signal to an electronic circuitry means;

B. an infra-red sensing means to detect when said basketball moves through a hoop on said backboard and send a signal to said electronic circuitry means;

C. a battery with charging circuitry to power said electronic circuitry means through a power control circuit that automatically shuts off power when said multifunctional basketball game monitoring unit has not been in use for a minimum of ten minutes time;

D. a housing containing:

1. said electronic circuitry means,
2. a scoreboard display unit with power on/off switch, a time mode on/off switch, a start switch, four period lights, a player number choice switch to choose between one and two players, a player 1 and a player 2 score display and a timer display,
3. a speaker,
4. said battery with said charging circuitry,
5. means to connect said electronic circuitry means with said impact sensing means, and said infra-red sensing means so that:
   (a) with said player number choice switch set to one player and said time mode switch in the ON position said electronic circuitry means acts to:
      1. cause said timer display to display time remaining in each of four periods with said periods being indicated by said four period lights,
      2. show the cumulative score in said player 1 score display and show the shooting percentage in said player 2 score display,
      3. emit a different audible tone through said speaker when said multifunctional basketball game monitoring unit is activated and each time said basketball passes through said hoop; each time a new high scoring percentage is reached, and each time only 10 seconds remains in a chosen time period;
   (b) with said player number choice switch set to one player and said time mode switch in the OFF position said electronic circuit means acts to:
      1. calculate and display the cumulative score in said player 1 score display and show cumulative shooting percentage in said player 2 score display,
      2. emit said different audible tone through said speaker when said multifunctional basketball game monitoring unit is activated and each time said basketball passes through said hoop;
   (c) With said player number choice set to two players and said time mode switch in the ON position and when said player 1 depresses said start button said electronic circuitry acts to:
      1. emit said different audible tone through said speaker when ten seconds remain in each period and at the end of each of said periods and each time said basketball passes through said hoop,
      2. cause said timer display to display time remaining in a first period and to activate first of said four period lights,
      3. display said player 1's accumulative score on said player 1 score display until one of said four periods elapses,
      4. emit said different audible tone through said speaker when said player 2 depresses said start button and each time said basketball passes through said hoop,
      5. cause said timer display to display time remaining in a first period and to light a first of said four period lights,
      6. display said player 2's accumulative score on said player 2 score display until said player 2's first of said four periods elapse.

2. A multifunctional basketball game monitoring unit comprising:

A. a housing;

B. an electronic circuitry means in said housing with a printer output port, and a T.V. output port;

C. an impact sensor means mounted on a backboard to determine when a basketball impacts said backboard with said sensor means acting to send signals to said electronic circuitry means;

D. an infra-red detector means to detect when said basketball moves through a hoop on said backboard and send a signal to said electronic circuitry means;

E. a numeric keypad on said housing to input data and commands to said electronic circuitry in said housing;

F. said electronic circuitry means acting to:

1. emit different audible tones through a T.V. output port to a speaker in a T.V. each time said basketball passes through said hoop and each time a higher percentage score is made and at the end of a play period;
2. store, calculate and output to said T.V. plugged into said T.V. output port a cumulative score and a cumulative shooting percentage as play progresses;
3. store, calculate and output to a printer connected to said printer output port said cumulative score, said cumulative shooting percentage, time of day and date, and a player identification number, when said player identification number, has been entered to said electronic circuitry means through said numeric keypad.

3. A multifunctional basketball monitoring unit as in claim 2 where said electronic circuitry means comprises a central processing unit connected with a memory unit and an input-output controller with a non-erasable program in said memory unit to cause said central processing unit to calculate, store and output signals and data, said nonerasable program allowing a first code input from said numeric keypad to access stored data for output through a video processor to a T.V. unit and to said printer and a second code input to erase stored data.

4. A multifunctional basketball game monitoring unit comprising:

A. a housing,

B. an electronic circuitry means in said housing connected with a sensor means to determine when a basketball passes through a hoop, and with an impact sensor means to determine when said basketball impacts said hoop and when said basketball impacts the backboard, said electronic circuitry means acting to calculate, store, and display total score of baskets made and percent of baskets made of total baskets attempted.

5. A multifunctional basketball game monitoring unit as in claim 4 where said electronic circuitry means is adapted to be connected with a printer and a T.V. set and numeric keypad input to enter commands and data to a central processing unit of said electronic circuitry.

6. A multifunctional basketball game monitoring unit as in claim 5 where said electronic circuitry generates different audible tones for baskets made and highest percentage score achieved in a play period and through a video processor outputs to said T.V. said different tones and said total score of baskets made and said percent of baskets made of total of total baskets attempted.

* * * * *